US005613688A

United States Patent [19]

Carella

[11] Patent Number: 5,613,688

[45] Date of Patent: Mar. 25, 1997

[54] ARROW VANE

[76] Inventor: Richard F. Carella, 43640 Riverway Dr., Clinton Twp., Mich. 48038

[21] Appl. No.: 557,358

[22] Filed: Nov. 13, 1995

[51] Int. Cl.[6] ..... F42B 6/06

[52] U.S. Cl. ..... 473/586

[58] Field of Search ..... 273/420, 423, 273/416

[56] References Cited

U.S. PATENT DOCUMENTS

| | | | |
|---|---|---|---|
| D. 219,040 | 10/1970 | Jaffe et al. . | |
| 1,842,540 | 1/1932 | Cowdery | 273/423 |
| 2,443,395 | 6/1948 | Lutins . | |
| 2,887,319 | 5/1959 | Lay | 273/423 |
| 2,976,644 | 3/1961 | Crisci . | |
| 3,595,579 | 7/1971 | Benoit | 273/423 |
| 3,815,916 | 6/1974 | Meszaros . | |
| 3,881,730 | 5/1975 | Carella | 273/420 |
| 4,003,576 | 1/1977 | Carella | 273/423 |
| 4,012,043 | 3/1977 | Carella . | |
| 4,392,654 | 7/1983 | Carella . | |
| 4,502,692 | 3/1985 | Humphrey . | |
| 4,946,172 | 8/1990 | Wong . | |
| 4,982,968 | 1/1991 | Foley . | |
| 5,039,110 | 8/1991 | Honda . | |
| 5,257,809 | 11/1993 | Carrizosa . | |

*Primary Examiner*—Paul E. Shapiro

*Attorney, Agent, or Firm*—Remy J. VanOphem; Thomas A. Meehan; John VanOphem

[57] ABSTRACT

An arrow having a shaft that has a forward end, an oppositely disposed rearward end, a central axis and a plurality of axially elongated vanes mounted to the shaft contiguous the oppositely disposed rearward end thereof. Each vane of the plurality of axially elongated vanes has a planar portion tangentially attached to the shaft and an extended fin portion projecting from the planar portion in a direction away from the central axis of the shaft. The undersurface of the extended fin portion defines an air channel for channelling air flow along the undersurface of the extended fin portion to generate a rotating moment about the central axis of the shaft to provide increased rotation and increased stability to the shaft and improve flight accuracy of the arrow.

24 Claims, 3 Drawing Sheets

ARROW VANE

BACKGROUND OF THE INVENTION

1. Field of the Invention

The invention relates to an apparatus for stabilizing the flight of an arrow. More particularly, this invention pertains to a vane for an arrow that is particularly useful for improving the flight stability and rotation of arrows used either in the field of hunting or in competitive archery.

2. Description of the Prior Art

Historically, feather fletchings or synthetic plastic vanes are individually mounted on the rear end of the arrow shaft to act as guide wings in order to provide stability, rotation and drag to the arrow. The purpose of attaching fletchings or vanes to an arrow is to provide stability, rotation and drag in flight for accuracy in targeting or hunting. Generally, three flat vanes are mounted symmetrically for stability and offset for drag and rotation. For stability each flat vane gives lateral control and when three vanes are used stability is achieved. For drag-rotation the three flat vanes are each offset at a slight angle which gives drag and rotation to the arrow. In recent years two flat vanes were bent at right angles to form a decreasing pocket over the shaft for stability and drag-rotation. More recently, vanes have been formed into a flexible curved decreasing pocket over the arrow shaft to give stability and to moderate drag. Further, these vanes or fletchings cause the arrow to rotate in order to control the bending frequency of the arrow during flight due to column loading. This rotation also prevents hunting arrow broadheads from planing which results in a more accurate flight.

A new problem caused by the materials evolution is the carbon arrow. Carbon arrows are up to 40 percent lighter than aluminum arrows thus making them very critical to drag-gyration. Drag-gyration of the arrow is defined when the rear end of the arrow rotates concentrically about its axis in a circular motion off the flight trajectory line from the center of gravity of the arrow rearward. Also the invention of the compound bow has increased arrow speed causing planing due to speed and rotation problems for hunting arrows with broadheads. A further problem that results from the use of the compound bow is vane fluttering from high frequency fish tailing.

While the prior art has provided some solutions to vane fluttering, controlled drag, and arrow rotation, no solutions have been taught which address drag-gyration, increasing rotation without increasing drag, increasing stability without increasing vane size, and shaft vibration reduction. In an attempt to solve the above problems, Applicant and others have for a number of years been striving to perfect an arrow vane assembly which overcomes the problems associated with "materials evolution" and faster arrow speeds. For example, U.S. Pat. No. 3,815,916 to Meszaros teaches the utilization of thin sections of self-sustaining flexible synthetic resin as vanes which are integrated with a resilient tubular body portion for securing the fletching unit onto the arrow shaft. The vanes are disposed in a helical pattern on the body portion and extend in quarterly directed planes relative to the shaft of the arrow. By so mounting the vanes, they are stressed aerodynamically in flight in opposition to their own rigidity, thereby preventing vane flutter even though the vanes are of extremely thin cross section. By minimizing or eliminating the possibility of vane flutter, the vanes are made thin enough and sufficiently light in weight to compare favorably with feather fletchings in performance characteristics. Further, Meszaros teaches greater durability of the vanes over feather fletching which is less sensitive to weather conditions and is less costly than feather fletching.

It is important to note that in Meszaros the net force generated to rotate the arrow results from the air traveling along the shaft and acting on the quarterly disposed vane which is mounted to the shaft in a somewhat helical relationship to generate rotation of the arrow.

Applicant's own contribution to solve the stated problems associated with prior art arrows includes U.S. Pat. No. 3,853,320 which discloses a vane system which is disposed completely on one side of the arrow shaft and includes vanes extending radially from an axis spaced from the shaft; U.S. Pat. No. 3,756,602 wherein the vanes are disposed on one side of the shaft and slanted or inclined downwardly from the forward end to the rearward end thereof relative to the axis of the shaft; and U.S. Pat. No. 4,003,576 wherein the vane system includes a pair of vanes disposed on one side of the shaft with one of the vanes angled upwardly from the front to rear and the other vane angled downwardly from the front to the rear. All of these prior contributions by Applicant are as a result of an effort to develop a vane system which would not interfere with the arrow rest upon release of the archery arrow.

A further contribution by the Applicant is exemplified by U.S. Pat. No. 4,012,043 which provides a vane system including two vanes disposed on diametrically opposed sides of an arrow shaft with each vane being spaced from the arrow shaft and inclined upwardly and outwardly from the vane shaft in a direction from front to rear extending coextensively with the diameter of the shaft so as not to interfere with the arrow rest upon release of the arrow. The vanes are supported in spaced relationship to the shaft support means defined by oppositely disposed fins extending from diametrically opposed sides of the shaft tangentially to the circumference of the shaft in opposite but parallel directions (note that for each vane the lateral or extended portions from the upstanding planar portions extend over the body of the shaft). Yet a further contribution by the Applicant is U.S. Pat. No. 4,392,654 which teaches an arrow vane consisting of a foot adapted to mount the vane on an arrow shaft along a radial direction and having front and rear ends spaced longitudinally along the shaft, the vane of the fletching projects from the foot and has a continuously curved shape that extends over a major portion of the projecting height of the vane from the foot and is inclined inwardly towards the foot in a rearward direction. The curved shape of the vane extends over the body of the shaft and at its inward inclination in a rearward direction defines a pocket for restriction of air flow while allowing the vane to flex in a manner that moderates drag in response to wind changes. Another embodiment of the vane is made from sheet material such that the vane projects tangentially from an arrow shaft on which the foot is mounted. The sheet material itself has a curved cylindrical shape with the foot extending angularly with respect to the axial direction of the cylindrical shape so as to provide an inward inclination in a rearward direction of the curved vane with the fletching mounted on an associated arrow shaft. The foot is disclosed as having a straight terminal edge and the vane includes a curved terminal edge extending between the front and rear ends of the foot.

As is taught in U.S. Pat. No. 4,392,654 flexing of the vane moderates drag in response to any change in the head or tail wind and, in addition, accommodates for any side wind changes. An increase in head wind produces an increased pressure build-up in the curved vane pocket. Such pressure build-up flexes the vane outwardly to decrease the restriction of air flow and thereby decrease the frictional drag generated during flight such that the arrow does not fall short of its intended target. A decrease in the head wind decreases the pressure build-up in the curved vane pocket. In response to this pressure decrease, the vane flexes inwardly to produce a greater restriction of air flow and thereby increase the frictional drag such that the arrow does not fly over the intended target.

A tail wind produces an increased pressure build-up in the curved vane pocket. Such pressure build-up flexes the vane inwardly to increase the restriction of air flow and thereby increase the frictional drag generated during flight such that the arrow does not over fly its intended target. An increase in the side wind from either direction produces a greater extent of arrow rotation so that the axis of the air flow shaft does not move angularly with respect to the direction of its intended trajectory and change the drag on the arrow as normally takes place with conventional arrows. Each vane flexes outwardly a slight extent as it is blown in the direction of the side wind to provide an increased rotational impetus and each vane flexes inwardly a slight extent during movement into the side wind to facilitate the arrow rotation. This flexing thus increases the speed of the arrow rotation as a result of increased side winds to increase flight stability. Any increase or decrease in side wind results in a corresponding change of degree of vane flexing that takes place in response to such side wind change in order to moderate drag and thereby enhance flight stability along the desired trajectory.

It is clear when viewing the cross-sectional FIGS. 2 through 4 or 5 through 7 that due to the mounting of the fletching along a radial direction of the axis of the shaft, the vane extends over the shaft of the arrow. Such is the case in either direct radial mounting as shown in FIGS. 2 through 4 or tangential mounting such as is shown in FIGS. 5 through 7. By the vane extending over the body of the shaft, as stated in the reference, a pocket is developed under the vane and shaft which allows air to travel therethrough and act on the vane to generate the associated drag and desirable rotation. It is the pocket and its rearward slant that are defined by the teachings of the prior art which generates the drag and effective force causing the rotation of the arrow. However, due to the restricted space between the underside of the vane and the body of the shaft, a limited restriction to air flow is generated within the "pocket" resulting in air disturbances or instabilities which adversely affect stability during flight creating undesirable so called "gyration" or instabilities at long distances with the lighter arrows used in competition and the planing of the heavier broadhead arrows used for hunting purposes.

Further attempts to reduce fluttering are shown in Honda, U.S. Pat. No. 5,039,110, which teaches a substantially cylindrical shaft with front and rear ends and a plurality of fletchings fixed thereto adjacent to its rear end. Each of the fletchings has a generally symmetrical shape that extends from a substantially straight bottom edge. The fletchings are spaced angularly about the shaft and mounted tangentially to its periphery in a stiff design that allows the flight of the arrow to take place substantially unimpeded by flutter accumulation.

Accordingly, what is needed is a vane configuration which allows increased flight stability and increased rotation without increasing drag. This would eliminate broadhead planing, arrow gyration, and reduce dampening of arrow vibration thus allowing increased flight accuracy.

SUMMARY OF THE INVENTION

The invention is a vane for an arrow which provides greater rotation and stability without increasing drag or vane size. The invention provides greater accuracy for hunting and target arrows than any previously known vane system as has been proven by actual use and wind tunnel tests.

The invention is accomplished according to the preferred embodiment of the arrow vane which includes a side or tangential mount attachment to the shaft with an upright planar portion and base edge portion coextensive with a tangential portion with respect to the arrow shaft. A fin portion projects laterally from the planar portion in a direction away from the axis of the arrow shaft so that it does not overhang the arrow shaft thus creating an additional rotational moment arm to the shaft as will be made clear hereinafter. The vane is fastened so that the base edge is attached parallel to the axis of the arrow and the fin portion is inclined downwardly towards the rear of the arrow shaft to build up air pressure and drag. This downward angle will be known as "fin pitch angle". The extended fin portion defines an underlying surface along which unrestricted air flows to create rotation, stability, and drag in flight. Each planar portion of the vanes provides lateral stability and each fin portion of the vanes provides radial stability.

Another alternate embodiment of the vane is made from plastic sheet material which includes a side or tangential mount attachment to the shaft with the planar portion and the base edge tangentially oriented with respect to the arrow shaft and non-parallel to the shaft axis. A fin portion projects laterally from the planar portion in a direction away from the axis of the arrow shaft so as to not overhang the arrow shaft. Both the fin portion and base edge portion are inclined downwardly towards the rear of the shaft so as to be non-parallel to the centerline of the shaft to build up air pressure and drag. The fin portion defines an underlying surface along which unrestricted air flows to create rotation, stability, and drag in flight. Each planar portion of the vane gives lateral stability and each fin portion of the vane gives radial stability.

Another important feature of the contoured fins is that they dampen the bending frequency thus allowing for greater accuracy of the shot. This dampening effect gives a wider range of tuning to an arrow. This new vane allows a broadhead arrow to shoot as accurately as a target point.

Because the fins extend laterally in a direction away from the arrow shaft a radial stability force is added and rotation is increased by a significant factor without increasing drag or vane size. Therefore, the invention provides increased flight control without increasing the size of the vane, increased rotation without increased drag, and improved frequency dampening to maximize aerodynamic stability of the arrow as it travels along its intended trajectory.

Both embodiments are disclosed on an associated arrow with three vanes spaced symmetrically about the rear end of the arrow shaft. When three vanes are used, the three bent fin portions lock the arrow axis on the flight line. The three bent fins act to provide additional stability to the arrow shaft when in flight. In the preferred embodiment, three vanes are side or tangentially mounted to the shaft and the base edge is parallel to the longitudinal direction of the shaft axis with the planar portion tangential to the outside diameter of the shaft. This orientation of the fin portion in a lateral direction away from the axis of the shaft increases rotation without increasing drag. The fin portion also adds radial force stability. In the preferred embodiment, the downward inclination in a rearward direction of the contoured fin portion of the vane produces drag, rotation, and radial stability.

A primary object of the present invention is to maximize stability of a carbon or broadhead arrow while providing desired drag control and maximum rotation of the arrow shaft in order to enhance flight control of the arrow as it travels to its intended target.

A primary object of the present invention is to increase rotation without increasing drag.

Still a further object of the invention is to increase stability without increasing the vane size.

Still a further object of the invention is to reduce bending frequency of an arrow shaft in flight.

Still another object of the invention is to smoothen air flow around the arrow shaft and through the fin portion.

A further object of the invention is to provide an improved vane system that can be used on broadhead arrows to stop planing.

Still another object of the invention is to provide an improved vane which allows heavy aluminum arrows with broadheads to be shot at high speed.

Still another object of the invention is to shoot lightweight carbon arrows without drag-gyration.

Still another object of the invention is to provide an improved vane which can be repaired in the field with two-way adhesive tape and stripping tape.

Still another object of the invention is to provide an improved vane that has greater clearance through the arrow rest.

The foregoing and additional features and advantages of this invention will become further apparent from the detailed description that follows. The written description is accompanied by a set of drawing figures. Numerals of the written description, corresponding to those of the drawing figures, point to the features of the invention. Like numerals refer to like features throughout both the illustration and the written description.

DETAILED DESCRIPTION OF THE PREFERRED EMBODIMENT

Figure 1:
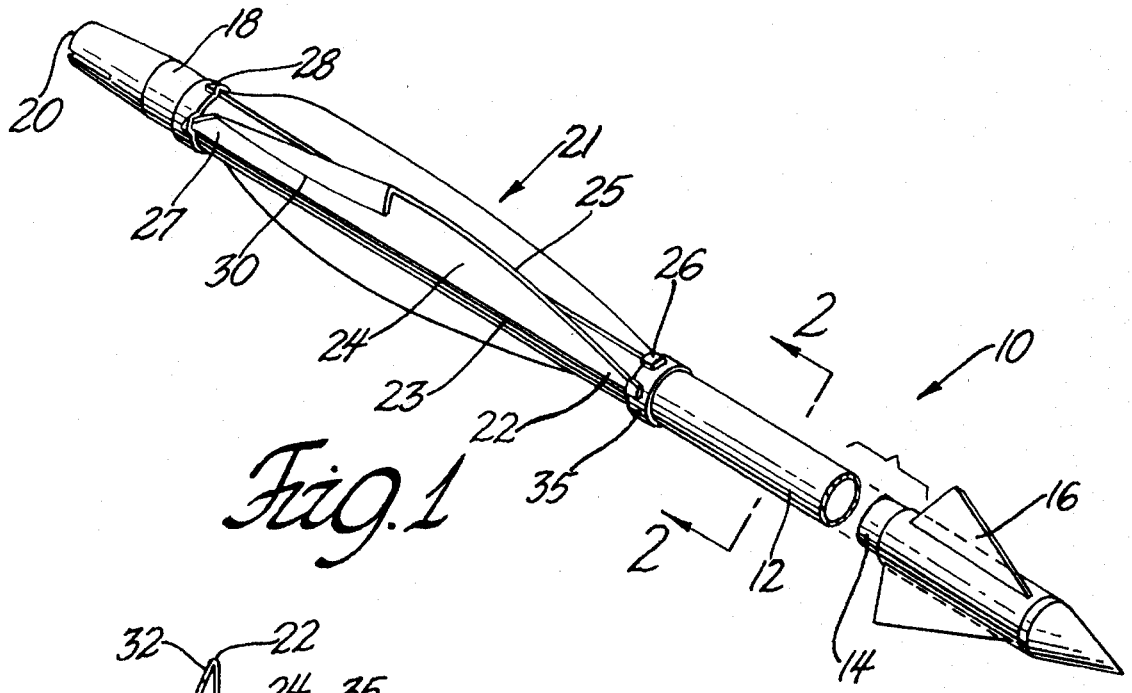
FIG. 1 is a perspective view of an arrow incorporating the teachings of the preferred embodiment of the present invention.

Referring to FIG. 1 of the drawings, a partially broken away arrow generally designated by reference numeral 10 includes an elongated arrow shaft 12 having a front end 14 on which a hunting head 16 is mounted and a rear end 18 on whose rearward extremity a nock 20 is mounted. The arrow 10 includes three symmetrically spaced vanes or fletchings 21 constructed in accordance with the present invention having a pocket or channel to improve flight stability of the arrow and to increase rotation without increasing drag as is hereinafter more fully described. The drawings illustrate three vanes 22, which is the most preferred number although more or less than three vanes may be used.

With reference to FIGS. 1 through 4, each vane 22 includes a base edge 23 coextensively disposed with a planar portion 24 for tangentially side mounting the vane on the arrow shaft 12. Each vane 22 includes front and rear ends 26 and 28 that are illustrated aligned longitudinally along the arrow shaft 12 and parallel to a central shaft axis 11. A fin portion 30 of each vane 22 extends laterally from the planar portion 24 and has an arcuate or contoured shape 32 that extends in a direction away from the central axis 11 of the shaft 12.

The contoured or arcuate shape 32 of the fin portion 30 of the vane 22 is inclined downwardly toward the shaft 12 in a rearward direction, as shown in FIG. 1, to define a passage or channel 34 for creating air flow and drag during flight of the arrow along its intended trajectory.

Figure 2:
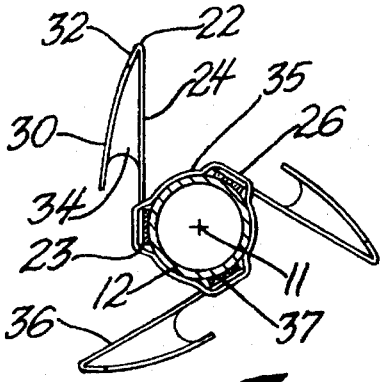
FIG. 2 is a sectional view taken through the arrow along line 2—2 of FIG. 1 and illustrates three vanes of an arrow in an unflexed or rest position.
Figure 4:
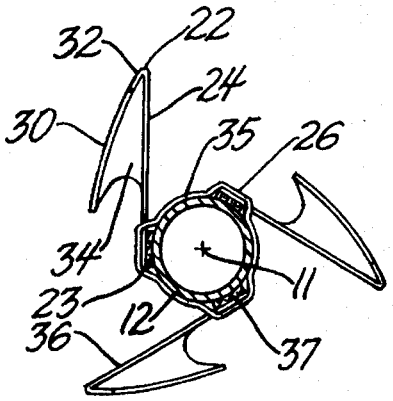
FIG. 4 is a view taken along the same direction as FIG. 2 but illustrating the vanes of the fletchings partially flexed as the arrow is slowing down.
Figure 3:
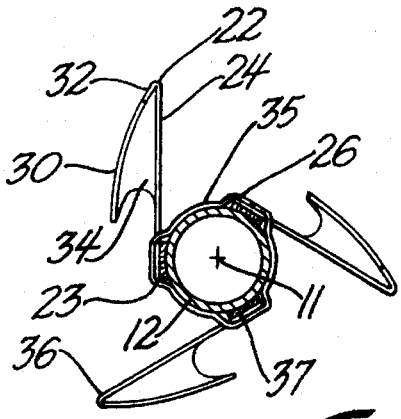
FIG. 3 is taken in the same direction as FIG. 2 but with the vanes of the fletching fully flexed in an outward direction as would be the case during arrow flight at maximum arrow speed.

As seen in FIGS. 2 through 4, the planar portion 24 of the vane 22 has an inwardly facing mounting surface 36 terminating at the base edge 23 for tangentially mounting the vane on the side of the arrow shaft by suitable ⅛ inch width double-sided tape 37 with the ends 26 and 28 being wrapped with a ¼ inch width stripping tape 35. The stripping tape prevents the vanes from shifting or lifting up at the front end and rear end of the vane. It is contemplated that either means for attaching the vane to the arrow may be used.

Figure 5:
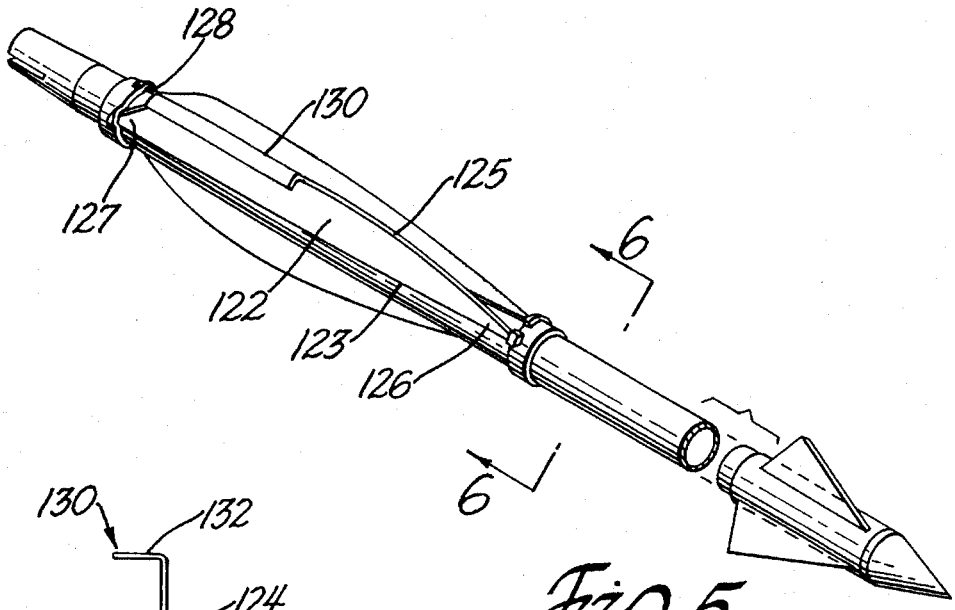
FIG. 5 is an alternate embodiment similar to FIG. 1 incorporating the teachings of the present invention except that the base edge mounting is shown not parallel to the shaft axis.
Figure 6:
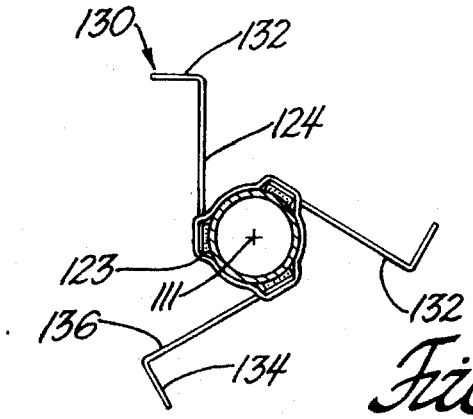
FIG. 6 is a sectional view taken through the arrow along line 6—6 of FIG. 5 and illustrates three vanes on the arrow.

In FIGS. 5 and 6 like features have been designated with like numerals preceded by a "1". As shown in FIG. 5, the front end 126 of the vane 122 projects tangentially to the shaft throughout the extent thereof between the front end 126 and rear end 128 to an outer terminal edge 125 of the vane 122. The rear end 128 of the vane 122 has an inner portion 127 coextensive with the base edge 123 that projects tangentially to the shaft from the base edge 123 to the fin portion 130.

The contoured or arcuate shape 132, or in the alternative a planar fin portion 132 as shown in FIGS. 5 and 6, defines a fin surface that essentially is parallel to the base edge 123. However, the vane is mounted to the shaft with a downward inclination towards the rear of the arrow to create radial forces for stability, greater rotational drag, and to dampen the bending frequency to the arrow. In FIGS. 2 through 4, the contoured shape 32 is shown as being circular about a direction parallel to the locus of the centerline about which is formed the cylindrical shape of the vane as will be discussed in detail hereinafter so as to provide a downward inclination of the fin portion 30 in a rearward direction when the base edge 23 of the vane 22 is longitudinally mounted parallel to the arrow shaft axis 11.

Figure 10A:
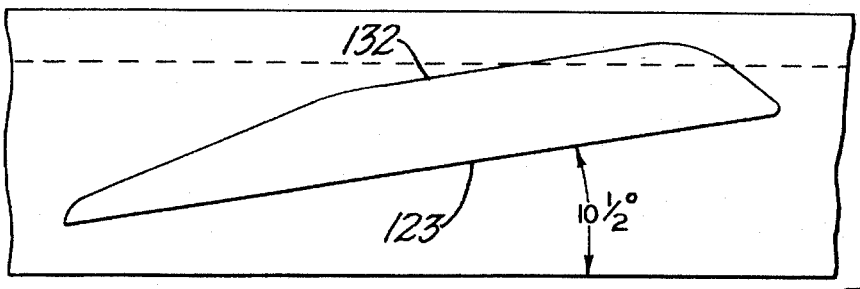
FIG. 10A shows a production method for forming and die cutting vanes.
Figure 10B:
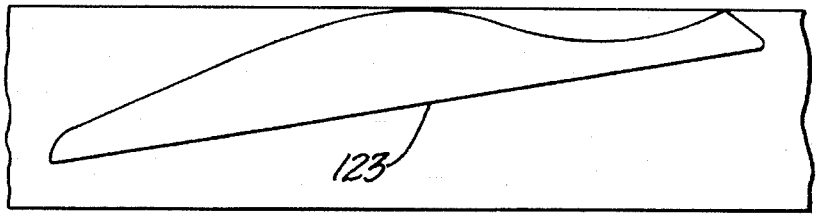
FIG. 10B is a side view of the vane and associated ribbon from which it is die cut after forming the extended fin portion.
Figure 10C:
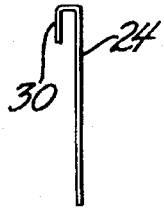
FIG. 10C is an end view of FIG. 10B.

The fletching or vane 22 is made from a resilient material, preferably synthetic plastic like polyester sheeting from 0.002 to 0.010 thick. Preferably, the vane 22 is heat formed first then die-cut. As shown in FIG. 10A, the vane of the preferred embodiment is made from a flat polyester sheeting and placed on a 10½° angle with respect to the edges of the polyester strip. This flat strip is then processed through a forming fixture which by the use of heat bends the one edge of the polyester strip at 180° to define the fin portion of the vane as shown in FIG. 10C. After the fin portion is heat formed using the forming fixture the complete fin is die cut from the polyester tape to define a complete vane as shown in FIG. 1. For the alternate embodiment shown in FIG. 5 the base edge 123 is aligned parallel to the edge of the polyester strip, heat formed and die cut so that when the vane is mounted on the arrow as shown in FIG. 5 the top edge of the contoured fin 132 is parallel to the base edge and inclined downwardly towards the rear of the shaft. This method would be similar to that disclosed in Applicant's U.S. Pat. No. 4,510,109. The contoured or arcuate fin portion is heat formed from 1/32 to 1/8 of an inch diameter and is die-cut in a downward inclination of the fin portion 30 from front to rear of the vane 22 and provides the appropriate radial force moment arm to generate rotation and stability of the arrow for flight control along its desired trajectory as hereinafter described.

Figure 7:
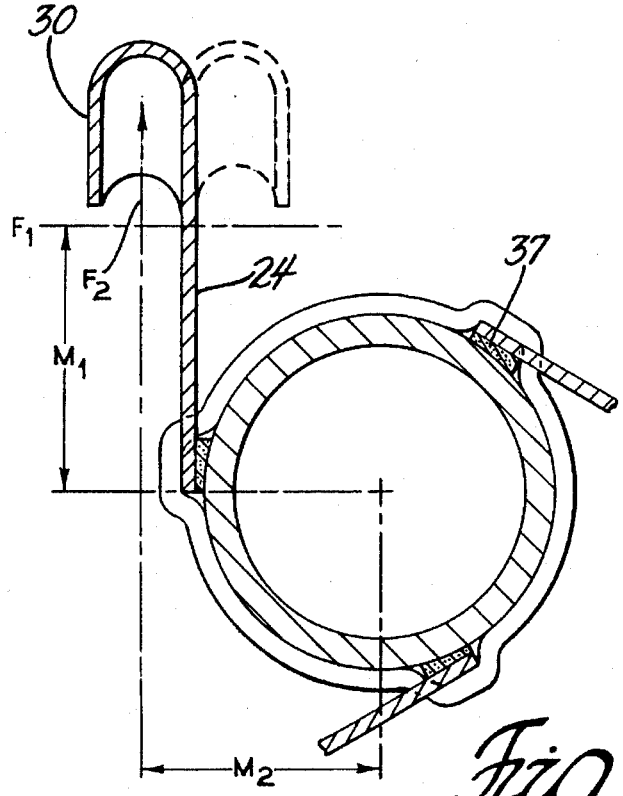
FIG. 7 is an exploded cross-sectional view similar to FIG. 2 which illustrates the forces acting on the arrow to rotate the arrow during flight.

The manner in which the vane responds to air flow and provides the enhanced stability by having a fin portion extending away from the axis of the shaft will now be made clear. With reference to FIGS. 2 through 4, and 7, the vane 22 is illustrated in FIG. 2 in an unflexed position such as is the case prior to flight. As the arrow is released, air flow rearwardly with respect to the arrow shaft 12 occurs along the underside of the extending contoured fin portion 30 of the vane 22. Because of the rearward, downward inclination of the fin portion of the preferred embodiment the air flow is deflected by the fin portion so as to generate a radial force F2 in an upward direction as shown in FIG. 7. As is clear from FIG. 7, the radial force F2 operates as a moment arm about the central axis of the shaft and its effect is to cause the shaft to rotate in a clockwise direction as viewed in FIG. 7. The air is redirected on the underside of the vane which results in the radial force F2 flexing the vane outwardly to a small degree depending upon the velocity of the air passing underneath the vane 22 or the thickness of the material of the vane. As the vane flexes the moment arm M2 increases since the effective force F2 is applied to a larger effective surface area of the vane.

This flexing as shown in FIGS. 3 and 4 is a reaction to the speed of the arrow; the faster the arrow, the more the fin portion opens up and the greater the moment arm M2 for the radial force F2. This moment arm M2 for the radial force F2 is significantly greater than when the fin portion is over the arrow shaft. This is why the rotation is significantly increased when the fin portion is not over the shaft than when it is. The same drag exists whether over the shaft or not. So for the same drag with the fin portion not over the arrow shaft, the arrow will rotate up to twice as much. This is an important improvement for hunting arrows with broadheads. Also, when the fin portion is not over the arrow shaft, this additional radial force F2 is created for stabilization. This extra rotation and resulting stability comes from the same size vane that was over the arrow shaft as shown in broken lines in FIG. 7. Accordingly, a flat vane of the same blank size can increase rotation and increase stability when a small portion of the top of the vane is bent away from the shaft rather than over the shaft.

In actual tests using a carbon arrow with a vane blank of identical size with one vane having a configuration as taught in the '043 Carella prior art patent and the other vane blank having a configuration according to the invention set forth herein, an arrow shot an 8 foot distance experienced a 90° rotation with a vane configuration of the '043 Carella patent while the same arrow shot at the same speed and distance experienced a 180° rotation utilizing the vane arrangement as set forth in the invention. The vanes were shot at 65 yards with both styles of vanes shooting the same height. The new invention vane shot better grouping overall than the vane as constructed according to the '043 patent.

In viewing FIG. 7 it is now clear that as a result of mounting the vane with a laterally extended fin portion 30 from the planar portion 24 in the direction away from the center of the shaft, the rotational characteristics of the arrow are now significantly enhanced by the fact that there are two forces F1 and F2 acting on the vane at the maximum extent of the respective moment arms M1 and M2 in order to assist in the rotational characteristics of the arrow, thereby significantly increasing the stability and rotation of the arrow without significantly changing the drag. For purposes of comparison, the prior art vane has been shown in FIG. 7 in dotted-line form. All the prior art known to date defines a vane which has an extending portion which extends over the shaft of the arrow, thereby minimizing the rotational effect. Accordingly, it is clear that a person skilled in the art will quickly see that by having the extended portion in the direction away from the centerline of the arrow, the rotational moment of the arrow is significantly increased as compared to the prior art devices which extend the vane over the arrow.

In the preferred embodiment as shown in FIGS. 1 through 4, the downward inclination in a rearward direction of the contoured or arcuate fin portion of the vane produces a small amount of flexing outward of the fin 30 which increases the radial force moment arm M2 and increases radial stability and rotation in response to increased arrow speed underneath the fin in order to provide additional flight control of the arrow as it travels along its trajectory. This additional radial stability force is reduced as arrow speed is reduced. This additional stability system allows stability when it is needed the most, which is in the beginning of the shot. This flexing of the contoured fins work best with fins made using 0.003 mylar.

Referring to FIGS. 5 and 6, there is shown an alternate embodiment of the vane fletchings in accordance with the present invention. As illustrated in the figures, each vane 122 includes a planar fin portion 132, that is formed from part of the planar upright portion 124 and is parallel to the base edge 123 which is tangentially attached to the shaft at a small angle to the centerline of the shaft so that the rearward portion 127 is lower than the front end 126 when viewed at a right angle to the planar upright portion 124. The planar fin extends laterally away from the axis of the arrow shaft so as not to overhang the shaft. The planar fin portion 132 functions identical to the fin portion 30 of FIGS. 1 through 4. The vane 122 is manufactured from a resilient material, usually a 0.004 polyester plastic film. FIG. 10A shows a vane that is formed from a continuous strip of polyester plastic film and then die-cut. The production method would be similar to that disclosed in the Applicant's U.S. Pat. No. 4,510,109.

Figure 9:
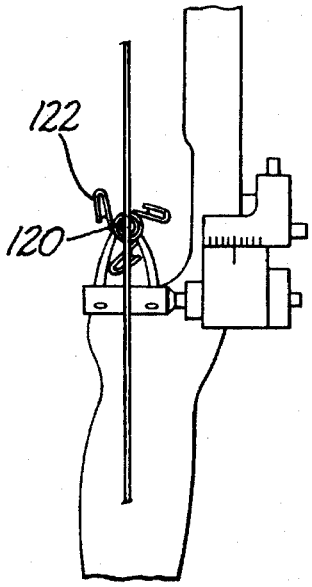
FIG. 9 is an end view of FIG. 8 with the vane in the arrow rest.
Figure 8:
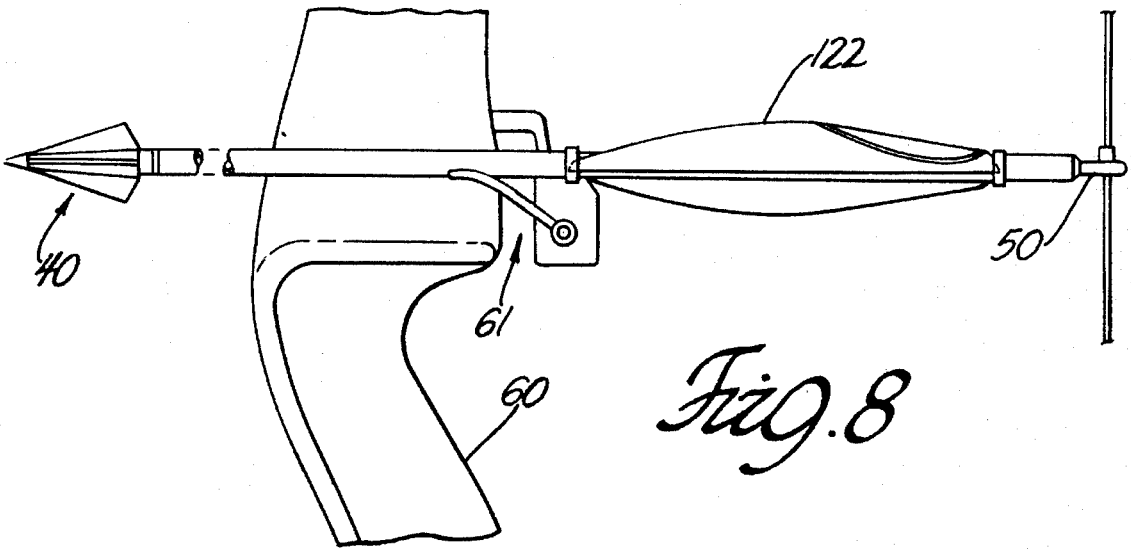
FIG. 8 is a fragmentary side view of a most preferred embodiment of the invention shown in the nock position with an archery bow.

FIG. 8 is a fragmentary side view of the embodiment of the invention as illustrated in FIGS. 1 through 4 showing the vane in relationship to an arrow rest 61 of an archery bow. FIG. 9 is a rear view of FIG. 8 showing the nock and vane position in relationship to the arrow rest and bow. With reference to FIGS. 8 and 9 a broadhead arrow 40 constructed according to the present invention is shown in the nock position 50 of an archery bow 60.

It is to be noted that the vanes 22 as constructed according to the embodiments disclosed herein when properly mounted on the arrow rest 61 do not in any way interfere with the arrow rest 61. Accordingly, the invention as proposed herein has absolutely no adverse effect whatsoever with respect to the mounting of the arrow within the bow. The embodiments of the invention disclosed herein when used on a hunter's arrow will provide the disclosed advantages concerning stability, drag and rotational impetus because the fin portion 30 of the vane extends from the planar portion 24 away from the central axis 11 of the shaft 12. The additional rotating force created by mounting the vane so as to extend a fin portion in a direction away from the shaft significantly increases the rotation of the arrow, especially for the heavier hunter's arrow. The increased stability and rotation without increasing the size of the vane or the drag greatly improves target arrow performance whether the arrow is made of carbon or aluminum.

The invention has been described in an illustrated manner, and it is to be understood that the terminology which has been used is intended to be in the nature of words of description rather than limitation. It is, therefore, to be understood that within the scope of the appended claims, the invention may be practiced otherwise than as specifically described in the embodiments set forth herein.

What is claimed is:

1. An arrow comprising:

a shaft having a forward end, an oppositely disposed rearward end, and a central axis; and a plurality of axially elongated vanes mounted to said shaft contiguous said oppositely disposed rearward end, each vane of said plurality of axially elongated vanes having a planar portion having a terminal edge at one end tangentially attached to said shaft without wrapping around said shaft, each said vane further having an extended fin portion projecting from an opposite end of said planar portion in a direction away from said central axis of said shaft whereby each extended fin portion of said plurality of axially elongated vanes extends in the same direction without overhanging said shaft, the undersurface of said extended fin portion and a radially outer surface of said planar portion defining an air channel for channelling air flow along said undersurface whereby said air flow along said undersurface of said extended fin portion generates a rotating moment about said central axis of said shaft to provide increased rotation and stability to said shaft and thereby improve flight accuracy of said arrow.

2. The arrow as claimed in claim 1 wherein said terminal edge is attached to said arrow such that said terminal edge is parallel to said central axis of said shaft.

3. The arrow as claimed in claim 1 wherein said terminal edge is mounted non-parallel to said central axis of said shaft.

4. The arrow as claimed in claim 1 wherein said extended fin portion is a planar surface transversely disposed to said tangentially attached planar portion.

5. The arrow as claimed in claim 1 wherein said extended fin portion is an arcuate surface extending from said tangentially attached planar portion.

6. The arrow as claimed in claim 1 wherein said extended fin portion is a contoured surface extending from said tangentially attached planar portion.

7. The arrow as claimed in claim 1 wherein said extended fin portion ms a partial cylindrical surface extending from said tangentially attached planar portion.

8. The arrow as claimed in claim 3 wherein said extended fin portion ms a planar surface transversely disposed to said tangentially attached planar portion.

9. The arrow as claimed in claim 3 wherein said extended fin portion ms an arcuate surface extending from said tangentially attached planar portion.

10. The arrow as claimed in claim 3 wherein said extended fin portion ms a contoured surface extending from said tangentially attached planar portion.

11. The arrow as claimed in claim 2 wherein said extended fin portion ms an arcuate surface extending from said tangentially attached planar portion.

12. The arrow as claimed in claim 2 wherein said extended fin portion ms a contoured surface extending from said tangentially attached planar portion.

13. The arrow as claimed in claim 1 wherein said plurality of axially elongated vanes are inclined downwardly from said forward end of said shaft towards said oppositely disposed rearward end.

14. The arrow as claimed in claim 2 wherein said plurality of axially elongated vanes are inclined downwardly from said forward end of said shaft towards said oppositely disposed rearward end.

15. The arrow as claimed in claim 4 wherein said plurality of axially elongated vanes are inclined downwardly from said forward end of said shaft towards said oppositely disposed rearward end.

16. The arrow as claimed in claim 5 wherein said plurality of axially elongated vanes are inclined downwardly from said forward end of said shaft towards said oppositely disposed rearward end.

17. The arrow as claimed in claim 6 wherein said plurality of axially elongated vanes are inclined downwardly from said forward end of said shaft towards said oppositely disposed rearward end.

18. An arrow comprising:

a shaft having a forward end, an oppositely disposed rearward end, and a central axis; and a plurality of axially elongated vanes mounted to said shaft contiguous said oppositely disposed rearward end, each vane of said plurality of axially elongated vanes having a planar portion having a terminal edge at one end tangentially attached to said shaft without wrapping around said shaft, each said vane further having an extended fin portion projecting from an opposite end of said planar portion in a direction away from said central axis of said shaft whereby each extended fin portion of said plurality of axially elongated vanes extends in the same direction without overhanging said shaft, said terminal edge being mounted to said arrow such that said terminal edge is parallel to said central axis of said shaft, said extended fin portion of each vane of said plurality of axially elongated vanes being inclined downwardly from said forward end of said shaft towards said oppositely disposed rearward end such that the undersurface of said extended fin portion and a radially outer surface of said planar portion define an air channel for channelling air flow along said undersurface of said extended fin portion whereby said air flow along said undersurface of said extended fin portion generates a rotating moment about said central axis of said shaft to provide increased rotation and stability to said shaft and thereby improve flight accuracy of said arrow.

19. An arrow comprising:

a shaft having a forward end, an oppositely disposed rearward end, and a central axis; and a plurality of axially elongated vanes mounted to said shaft contiguous said oppositely disposed rearward end, each vane of said plurality of axially elongated vanes having a planar portion having a terminal edge at one end tangentially attached to said shaft without wrapping around said shaft, each vane further having an extended fin portion projecting from an opposite end of said planar portion in a direction away from said central axis of said shaft whereby each extended fin portion of said plurality of axially elongated vanes extends in the same direction without overhanging said shaft, said terminal edge being mounted to said arrow such that said terminal edge is non-parallel to said central axis of said shaft, said extended fin portion of each vane of said plurality of axially elongated vanes being parallel to said terminal edge such that the undersurface of said extended fin portion and a radially outer surface of said planar portion define an air channel for channelling air flow along said undersurface whereby said air flow along said undersurface of said extended fin portion generates a rotating moment about said central axis of said shaft to provide increased rotation and stability to said shaft and thereby improve flight accuracy of said arrow.

20. The arrow as claimed in claim 2 further comprising an adhesive disposed between said terminal edge of each of said plurality of axially elongated vanes and said shaft.

21. The arrow as claimed in claim 20 wherein said adhesive is a two-sided adhesive tape.

22. The arrow as claimed in claim 1 wherein each vane of said plurality of axially elongated vanes has a first terminal end portion and an oppositely disposed second terminal end portion.

23. The arrow as claimed in claim 22 further comprising means for maintaining said first and second terminal end portions in contact with said shaft of said arrow such that during flight of said arrow said first and second terminal end portions remain in constant contact with said shaft.

24. The arrow as claimed in claim 23 wherein said means for maintaining contact with said shaft comprises an adhesive strip tape means surrounding said shaft with said first and second terminal end portions located between said adhesive tape strip means and said shaft.

* * * * *

UNITED STATES PATENT AND TRADEMARK OFFICE

CERTIFICATE OF CORRECTION

PATENT NO. : 5,613,688
DATED : March 25, 1997
INVENTOR(S) : Richard F. Carella

It is certified that error appears in the above-identified patent and that said Letters Patent is hereby corrected as shown below:

Column 10, line 5, delete "ms" and insert ---- is ---- .

Column 10, line 8, delete "ms" and insert ---- is ----.

Column 10, line 11, delete "ms" and insert ---- is ----.

Column 10, line 14, delete "ms" and insert ---- is ----.

Column 10, line 17, delete "ms" and insert ---- is ----.

Column 10, line 20, delete "ms" and insert ---- is ----.

Signed and Sealed this

Twenty-fourth Day of February, 1998

*Attest:*

Bruce Lehman

BRUCE LEHMAN

*Attesting Officer*

*Commissioner of Patents and Trademarks*